United States Patent [19]

Mains

[11] Patent Number: 4,479,171

[45] Date of Patent: Oct. 23, 1984

[54] SIDE ARM BATON AND FLASHLIGHT

[76] Inventor: Gregg B. Mains, 244 Centenial, Rancho Mirage, Calif. 92770

[21] Appl. No.: 526,458

[22] Filed: Aug. 25, 1983

[51] Int. Cl.[3] ..... A63B 15/02

[52] U.S. Cl. ..... 362/102; 362/109; 362/120; 362/205; 362/376; 362/390; 362/399

[58] Field of Search ..... 362/102, 109, 120, 205, 362/376, 390, 399

[56] References Cited

U.S. PATENT DOCUMENTS 3,737,649 6/1973 Nelson et al. ..... 362/102

*Primary Examiner*—Stephen J. Lechert, Jr.

*Attorney, Agent, or Firm*—Robert E. Strauss

[57] ABSTRACT

There is disclosed a combination of a side-handle baton and a flashlight in which the light bulb and reflector are located in the short end of the baton, remote from the battery which can be a rechargeable dry cell battery pack is located intermediate the length of the elongated club portion of the baton, centrally positioned to preserve the balance of the baton. The flashlight switch is located in the end of the side-handle which, preferably, has an enlarged bulbous end for gripping purposes. In preferred embodiments the side-handle includes a central, rotatable sleeve with an interchangeable extension block to permit adjustment of the side-handle to varied hand widths.

9 Claims, 8 Drawing Figures

SIDE ARM BATON AND FLASHLIGHT

BACKGROUND OF THE INVENTION

1. Field of Invention

This invention relates to a side-handle baton and, in particular, to the combination of a flashlight with such baton.

2. Brief Statement of the Prior Art

A very significant advance in defensive weapons was the modification of the conventional police baton to include a side-handle, thus adopting this weapon for defensive purposes by permitting trained law enforcement agents to defend themselves against attacks from the front, rear and sides in a very effective manner. This defensive weapon is to be carried with the elongated club portion under the arm of the agent and with the agent's hand grasping the upright side-handle. When so carried, the defensive weapon is in an "at ready" position and the agent can immediately execute any of a number of moves to disarm or repel an opponent.

Difficulties, however, are experienced when it is also necessary for the agent to use a flashlight since the free hand must hold the flashlight, thus leaving no hands free for other tasks such as opening doors, moving obstacles and the like. In these instances, the agent will release his grasp of the baton, disarming himself. An effective, single weapon including a flashlight would avoid these difficulties, however, none has heretofore been available.

The combination of a flashlight with a patrolman's night stick or club has been suggested as in U.S. Pat. Nos. 849,216; 1,018,358 and 1,066,540. The difficulty with these prior attempts, which were long ago abandoned, is that the attempts to incorporate a flashlight in a night stick compromised the functions of both the night stick and the flashlight. Typically, the flashlight was placed in the grip end of the night stick, requiring the user to reverse his hand position when changing between use of the flashlight and the night stick. Also, no attempts were made to mount the delicate portions of the flashlight in a protective manner so these components could withstand the shocks imposed during use of the night stick. These shortcomings surely led to the oblivion of these antiquated prior inventions.

BRIEF DESCRIPTION OF THE INVENTION

This invention combines a flashlight with a side-handle baton by locating the light source in a position which does not compromise any of the functions of the side-handle baton or flashlight. In fact, the functions of the side-handle baton are actually enhanced in the combination since the user retains complete freedom of both hands and functions entirely unimpeded while, nevertheless, having full benefit of a flashlight. To this end, the light source, i.e., bulb and reflector and lens subassembly, is located in the short end of the baton and the switch for the light is located in the end of the side-handle where it is easily reached by the thumb or forefinger of the hand grasping the side-handle, without shifting or significantly altering the normal grip of this defensive weapon. The battery for the light source is remotely located, intermediate the length of the elongated club portion of the baton, positioned to maintain balance of the baton. In this location, the battery is removed from the conventional flashlight juxtaposition to the light source and thus the delicate lens, bulb and reflector components can be mounted in a subassembly with adequate shock absorbing means to prevent their damage during use of the baton. In preferred embodiments, the side-handle has an enlarged bulbous end and/or a central, rotatable sleeve to permit maximum freedom in swiveling the baton.

BRIEF DESCRIPTION OF THE DRAWINGS

The invention will be described with reference to the illustrations of which.

DESCRIPTION OF PREFERRED EMBODIMENTS

Figure 1:
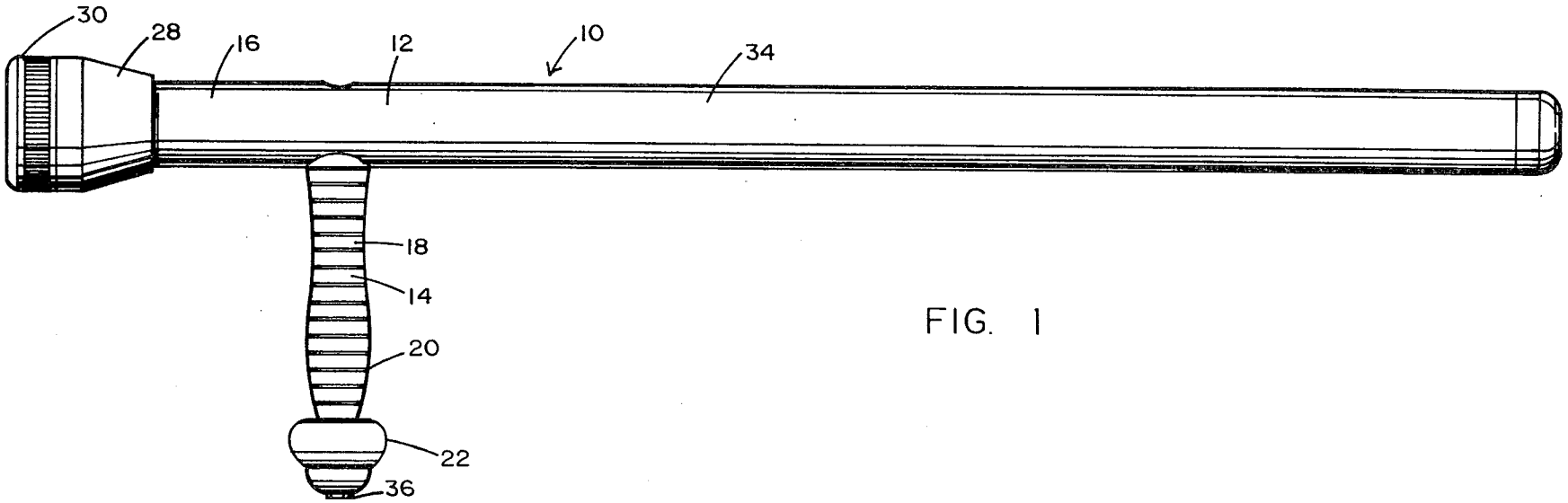
FIG. 1 is a side view of the baton on the invention.

Referring now to FIG. 1, the baton 10 of the invention has a generally conventional side-handle baton configuration. The baton has an elongated club portion 12 with a right angle side-handle 14 located approximately 1/6 to about ⅓its length from the short end portion 16 of the baton. Side-handle 14 can be contoured as shown with a central, reduced diameter mid-portion with smooth transition between the mid-portion and end portions. Preferably, the handle includes gripping means in the form of a plurality of grooves 20 spaced along the length of the side-handle 14. The side-handle also has a distal, bulbous knob 22 which facilitates grasping and retention of the baton by the user.

A light source is incorporated in the baton 10 in accordance with the invention by locating a light source in the open end of the short end 16 of the baton. For this purpose, a sleeve 28 is secured to the short end portion 16, preferably by threadable engagement. The sleeve 26 has a threaded end and receives a threaded cylindrical bezel 30 which retains the light subassembly in a manner described in greater detail with reference to FIG. 2.

The battery for the light is carried in the elongated club 12 of baton 10, preferably in the long end portion 34. The electrical connection between the batteries and the light source is in circuit through an electrical switch 36 located in the end of side-handle 14. Preferably, this switch has a momentary on and on/off positions so that when depressed and held the light is on; and when further depressed it switches on until it is again depressed to switch the light off.

Figure 2:
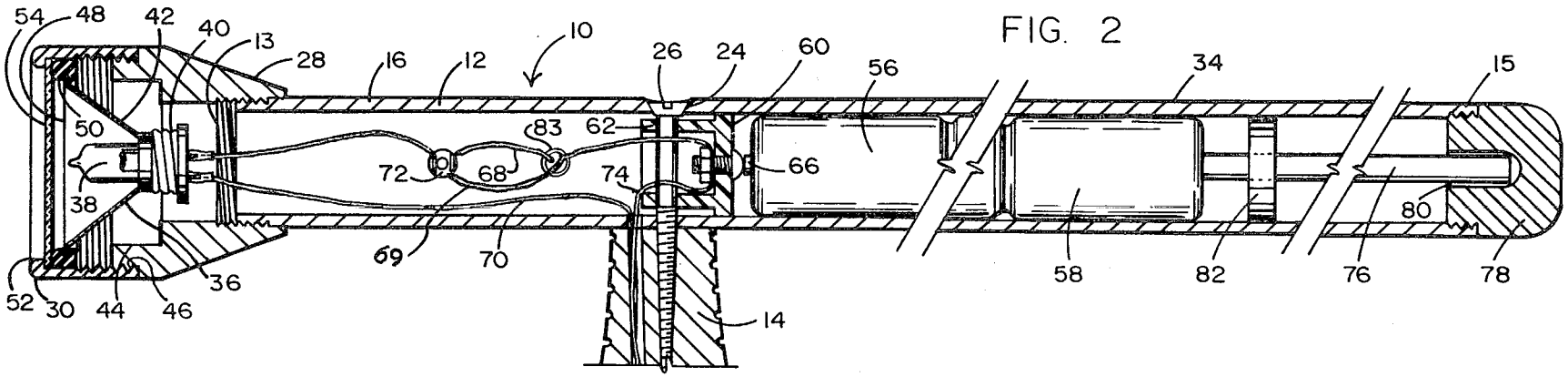
FIG. 2 is an enlarged sectional view of the baton illustrating the operative components.

Referring now to FIG. 2, the elements and their function of the combined light and baton will be described in greater detail. As shown in FIG. 2, the baton 10 comprises an elongated tubular club 12 having its opposite ends 13 and 15 threaded, externally and internally, respectively. At an intermediate position along its length, the tubular club supports side-handle 14 and, for this purpose, a through aperture 24 is provided to receive screw 26 that extends therethrough into threaded engagement with the shank of handle 14. As in the conventional construction for a side-handle baton, the side-handle 14 is located approximately 1/6 to ⅓ the length of the club from its short end 13, subdividing the club into short and long portions 16 and 34, respectively. The short end portion 16 of the club carries the light elements and these are formed as a subassembly 36 of a high intensity, preferably a halogen quartz, projector bulb 38 that is threadably received in the bulb receptacle 40 formed as an integral portion of the reflector and bulb holder element 42. An adapter sleeve 28 is threadably engaged on the external threaded end 13 of the elongated club 12. This adapter sleeve is counterbored at 44 and is provided with external threads 46. The reflector bulb receptacle subassembly 36 is received in counterbore 44 and the reflector has an annular lip 48 which is received in ring 50 formed of a suitable elastomeric substance. This subassembly is inserted into the counterbore with the elastomeric ring 50 bearing against the annular edge of the adapter sleeve 28 and is retained in this position by the bezel 30 which is a sleeve with internal threads received over the threads 46 of adapter sleeve 28 and which has an inwardly annular lip 52 which receives and retains the lens 54 of the light subassembly.

The battery for the light is contained at a remote location intermediate the length of the elongated club 12. Preferably, the battery pack comprises a plurality of commercial available rechargeable dry cells 58 assembled into a unitary battery pack 56 and is supported in the elongated tube by a spacer 60 which is a cylindrical cap that is received within the tubular club and which has a throughbore 62 which is aligned with throughbore 24 of the elongated club, thereby receiving screw 26, thus fixedly securing the spacer 60 to serve as an abutment stop for the battery pack 56. The cap also has a terminal post 64 centrally located for making contact with the positive terminal 66 of the battery pack and this terminal post is in circuit through conductors 69 and 70 to the external connector jack 72 for receiving a plug of a charging circuit for recharging of the battery pack, and the bulb 38. An LED element 83 can, optionally, be provided in a circuit through conductor 68 which extends to a switch (not shown) which is normally open, and closed to ground by the plug of the charging circuit to indicate when the battery is being charged. Additionally, the circuit includes the remotely located switch 34 and conductors 70 and 74 extend through handle 14 to this switch.

The battery pack is maintained in the assembly against axial movement or displacement by spacer rod 76 which extends between the end battery 58 and end plug 78. Plug 78 threadably engages the internal threads in the end 15 of the elongated club and has a centrally located bore 80 which receives one end of rod 76, thereby fixedly securing rod 76 in the assembly and immobilizing the battery pack against axial displacement. Rod 76 also serves as a terminal post for the negative side of the battery pack and is maintained in conductivity with the circuit and the end plug 78 which threads into mating contact with the internal side walls of the elongated club 12. A spacer disk 82 is received over the rod 76 and serves to maintain the rod along the axis of club 12.

Figure 3:
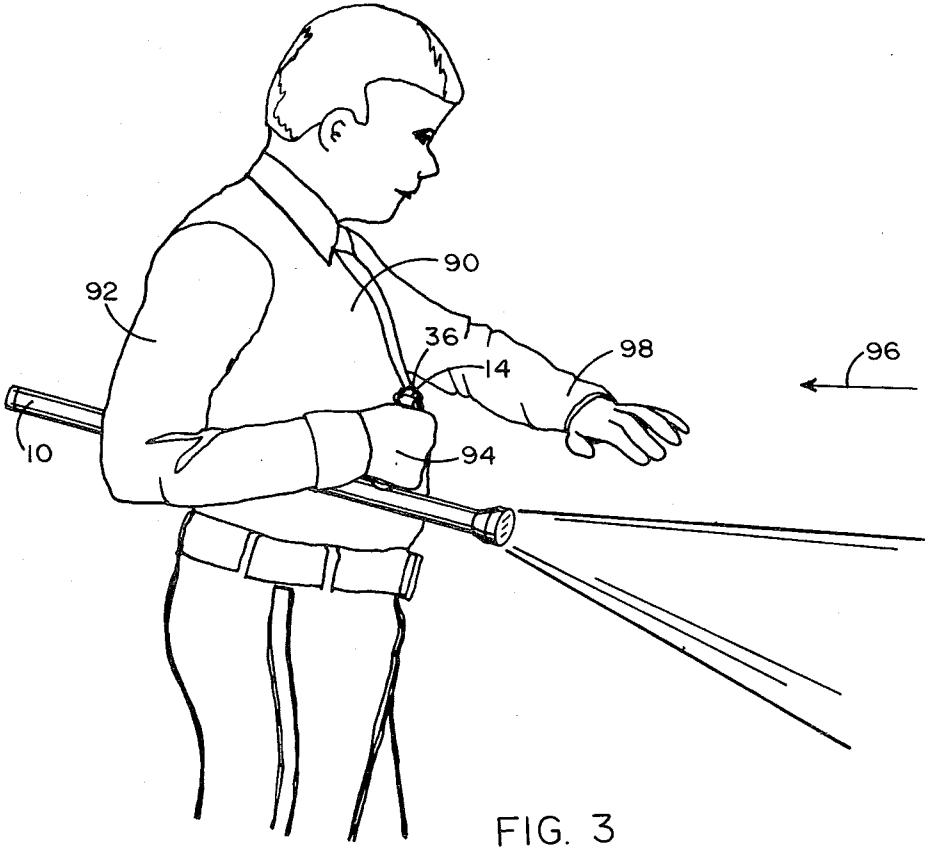
FIG. 3 illustrates the normal carrying position of the baton of the invention.

Referring now to FIG. 3, the baton 10 of the invention is illustrated in its ready position and with the flashlight in use. As there illustrated, the law enforcement agent 90 carries the baton under his arm 92 with the side-handle 14 in an upright position and grasped by his hand 94. In this position, the flashlight is directed forward and can be freely moved about, flooding the area in front of the agent with light. The flashlight is turned on by pressing the on/off button 36 or by using the momentary light, in which case, the agent can rest his thumb on the light switch 36.

Figure 4:
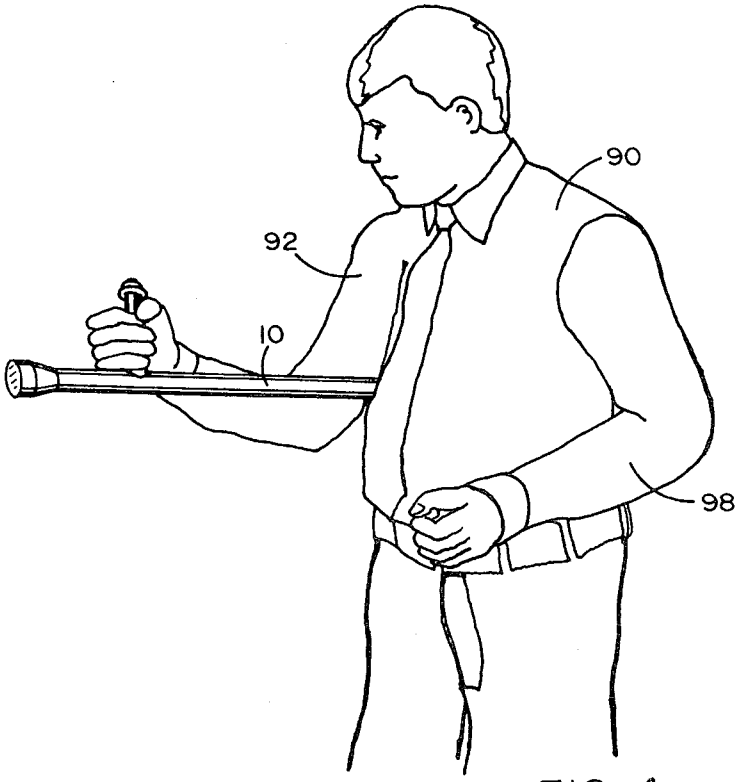
FIG. 4 illustrates use of the baton in a forward thrust movement.

In this ready position as shown in FIG. 10, the side-handle baton 10 is fully ready for immediate use by the agent 90. As shown in FIG. 4, the baton 10 is ready for a forward thrust in the direction of arrowhead line 96 by the agent who thrusts his arm 92 in a forward motion, to strike and disarm an attacker approaching from the front.

Figure 5:
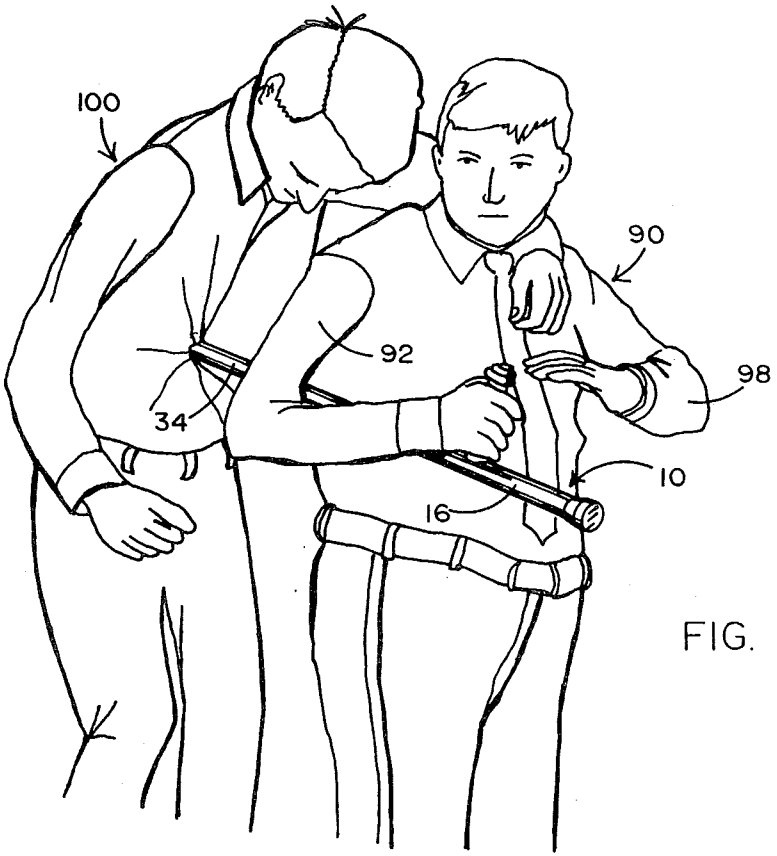
FIG. 5 illustrates use of the baton in a reverse thrust action.

In the event that the agent 10 is assaulted from the rear by an attacker 100, the side-handle baton 10 is in its ready position for immediate repelling this attack. This is illustrated in FIG. 5, where the agent moves his arm 92 in a rearwardly thrusting direction, striking the attacker with the long end portion 34 of baton 10.

In all of these movements, the conventional use of the baton is not compromised or interfered with to any degree by the presence of the flashlight on the short end portion 16 of the baton. In fact, the versatility of the side-handle baton for use at night or in dimly lit conditions is greatly improved by the combination since the agent at all times maintains his other arm 98 free for any movements or cooperative grasping of the baton.

In addition to the illustrated baton movements which can be fully executed by the baton-flashlight combination of the invention, the baton can also be used for basic movements such as defensive block positions, or spinning techniques heretofore used for side-handle batons, e.g., a forward spin in which the baton is dropped from its basic or ready position and swung in an arc across the chest of the agent and returned in a reverse spin. Similarly, an inside spin in which the side-handle baton is dropped to a vertical position beside the agent and then spun in a large vertical circle in front of the agent, can be practiced. None of these movements are compromised or hindered in any degree by the combination of the invention.

Figure 6:
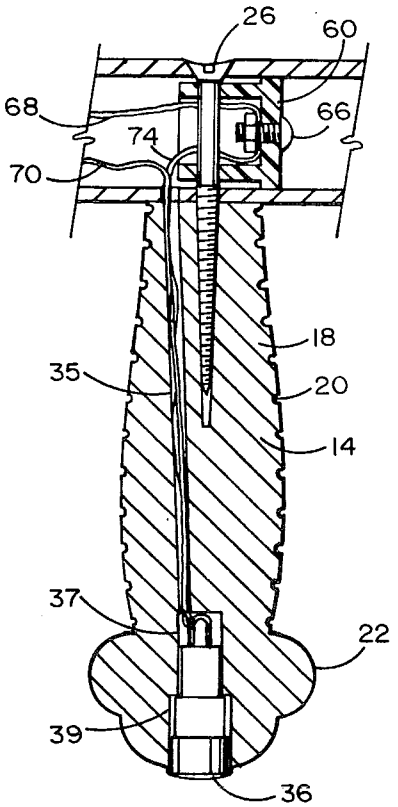
FIG. 6 is a sectional view of a side-handle of the baton.

Referring now to FIG. 6, there is illustrated a sectional view of a suitable handle 14 for use with the baton. This side-handle 14 is attached with screw 26 as previously described. The end of the screw is bored at 37 and counterbored at 39 to provide a receptacle for the electrical switch 36. A through bore 35 is provided through the handle to receive the conductors, including conductor 70 and 74 which extend into engagement with the terminal posts of electrical switch 36.

Figure 7:
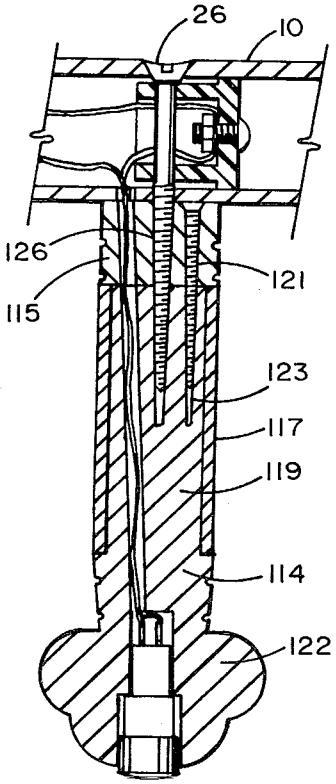
FIG. 7 is a sectional view of an alternative side-handle of the baton.

Referring now to FIG. 7, an alternative embodiment of the handle is disclosed. In this embodiment, the handle 114 is provided with a bulbous end 122 to facilitate grasping of the side-handle. The embodiment of FIG. 6, however, has a rotatable sleeve 117 which is received over a reduced diameter shank 119 of the handle 114 to provide rotatable mounting of sleeve 117. Preferably, the handle is secured to the baton 10 using a spacer block 115 which has approximately the same outer diameter as the rotatable sleeve 117. The spacer block 115 is secured in a subassembly to handle 114 by screw 121 which extends through a bore in spacer block 115 and into threaded engagement in a pilot hole 123 bored in the end of handle 114. The spacer block 115 has a central through bore 126 to receive the attachment screw 126 that secures the side-handle to the baton. The remainder of the construction of the side-handle baton is as previously described.

Figure 8:
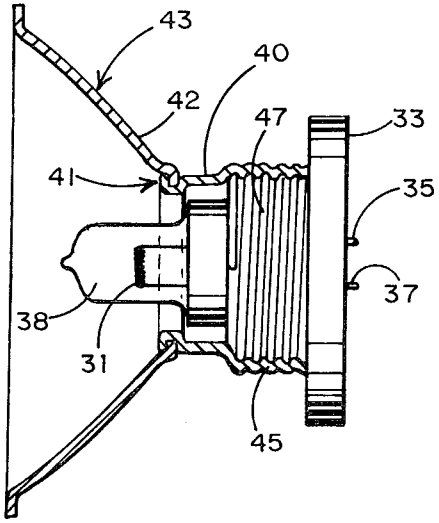
FIG. 8 is a sectional view of the light subassembly of the invention.

Referring now to FIG. 8, the preferred reflector and bulb subassembly will be described in greater detail. As there illustrated, the subassembly 43 includes a reflector 42 which is of a wide angle configuration, having a side wall angle of from 40 to about 60 degrees, preferably 45 degrees. The reflector is retained in a permanent assembly to the bulb receptacle 40 by a conventional lip and groove interlocking generally indicated at 41. The bulb receptacle is provided with internal threads 45 which are rolled into this cylindrical receptacle and these threads receive an externally threaded plastic plug 47. The bulb 38 is a high intensity projector lamp bulb and is imbedded in the plastic plug 47 with its terminal posts 35 and 37 extending through the end disk 33 of plug 47. This reflector and bulb subassembly provides for a fixedly adjustable positioning of bulb 38 in the reflector 42 thereby permitting adjustment of the light between flooding and spotlighting functions and enabling one to locate the bulb filament 31 at precisely the desired spacing relative to reflector 42 to achieve both a simultaneous spotlight and floodlight characteristic to the light source.

The invention has been described with reference to the illustrated and presently preferred embodiment thereof. It is not intended that the invention be unduly limited by this illustration of the presently preferred embodiment. Instead, it is intended that the invention be defined by the means, and their obvious equivalents set forth in the following claims.

I claim:

1. The combination of a side-handle baton and flashlight permitting one-handed operation thereof which comprises:

(a) an elongated tubular club;

(b) a short side-handle at right angles thereto attached medially on said club approximately 1/6 to 1/3 its length from one end, thereby forming short end and long end portions of said baton;

(c) an electrical bulb and reflector mounted in the short end portion, a lens and protective lens holder received over said bulb and reflector and removably attached to the short end portion of said baton;

(d) an electrical storage battery located in said elongated tubular club;

(e) an electrical switch mounted in the end of said side-handle; and (f) electrical conductor means in circuit with said switch, battery and bulb.

2. The combination of claim 1 wherein said storage battery is centrally located in said baton.

3. The combination of claim 2 wherein said battery is remote from said bulb and including an elastomeric ring between the outer edge of said reflector and the end of said elongated tubular club.

4. The combination of claim 1 including an enlarged distal knob on said side-handle.

5. The combination of claim 4 wherein said side-handle has a centrally located rotatable sleeve which is rotatably mounted on said side-handle.

6. The combination of claim 5 wherein said side-handle is an assembly of a short spacer, said rotatable sleeve, a main portion having a reduced diameter shank received in said rotatable sleeve and a stationary end portion including an enlarged distal knob, whereby said spacer may be interchanged with spacers of varied length to accommodate various user hand widths.

7. The combination of claim 1 wherein said reflector has a cone angle from 40 to 60 degrees to provide a short conical light assembly.

8. The combination of claim 7 wherein said electrical bulb is a spot effect bulb.

9. The combination of claim 8 wherein said bulb is secured in said reflector by adjustment means permitting variation in its position in said reflector to provide adjustment to obtain simultaneous spot and flood lighting.

* * * * *